US005546602A

United States Patent [19]

Hale

[11] Patent Number: 5,546,602

[45] Date of Patent: Aug. 20, 1996

[54] PROTECTIVE GEAR

[76] Inventor: Reggie D. Hale, 2505 Trails End Dr., Bentonville, Ark. 72712

[21] Appl. No.: 540,068

[22] Filed: Oct. 6, 1995

[51] Int. Cl.[6] ..... A41D 13/00; A41D 1/04

[52] U.S. Cl. ..... 2/2; 2/DIG. 3; 2/102; 128/874

[58] Field of Search ..... 2/2, 22, 23, 24, 2/DIG. 3, DIG. 10, 413, 102; 441/106, 107, 114, 115, 116, 117, 118, 119, 120; 128/874, 875, DIG. 20; 602/13

[56] References Cited

U.S. PATENT DOCUMENTS

| | | | |
|---|---|---|---|
| 102,419 | 8/1870 | Morris | 441/116 |
| 3,521,623 | 7/1970 | Nichols et al. | 128/DIG. 20 X |
| 4,483,332 | 11/1984 | Rind | 602/13 X |
| 4,621,624 | 11/1986 | Rayboy | 602/13 X |

FOREIGN PATENT DOCUMENTS

| | | | |
|---|---|---|---|
| 1400246 | 4/1965 | France | 2/DIG.3 |
| 2823370 | 12/1979 | Germany | 2/413 |
| 23128 | 12/1899 | United Kingdom | 441/115 |

*Primary Examiner*—Paul C. Lewis
*Attorney, Agent, or Firm*—Chase & Yakimo

[57] ABSTRACT

A garment for wear during game play provides protection against impact forces. The garment comprises inner and outer layers of a fabric mesh with an intermediate support layer. A support layer includes a primary air channel extending along the normal seam locations of the garment with an interwoven grid of secondary air tubes being in communication with the primary air channel. Pressurized air is introduced through a valve in the primary air channel so as to inflate the air channel and grids connected thereto. Upon inflation, the grids cover the underlying body parts so as to protect against impact forces. The valve allows for a quick deflation of the air channel for allowing the garment to be worn during normal game play. The garment may also be worn in non-game environments in order to support the underlying muscles of the wearer.

9 Claims, 4 Drawing Sheets

PROTECTIVE GEAR

BACKGROUND OF THE INVENTION

This invention relates to protective gear and, more particularly, to a body garment having a primary air channel extending along seams of the garment, the air being subsequently directed to an array of horizontal and vertical tubes in communication with the primary air channel.

An active fear of younger sports participants is being hit with a baseball, particularly a pitched baseball. As the players get older, the speed of the pitched baseball increases which exacerbates this fear. In some cases, the player may drop out of the sport due to such a concern.

There is no doubt that the safety of a hitter should be a primary concern as the hitter is the least protected among the umpire, catcher, batter trio. Although the hitter wears some basic protection, i.e., a helmet, the hitter has no protective gear for the body. Various protective garments have been proposed for use while playing contact sports. However, these garments are not usually suitable for baseball use. Moreover, such garments are not adapted for wear throughout the game. Thus, it is desirable to have a garment which can present a protective function without interfering with other aspects of the game.

In response thereto I have invented a garment suitable for continuous game wear which offers a first normal play mode and a second user-selectable protective mode.

My garment concept may be utilized in various forms of sports wear, the concept generally comprising a primary air channel which generally extends along the seams found along the joined sections of a garment or at free ends thereof. Extending between sections of this primary air channel is an array of interwoven, horizontal and vertical air tubes in communication with the primary air channel. A channel valve allows for entry of pressurized air into the primary channel for direction into the tube array. Upon inflation the secondary tube array will offer a protective latticed cushion against outside forces, such as thrown or batted baseballs. The channel valve quickly releases the air upon demand so that the garment can be worn without interfering with normal game play. The garment may take various forms and may be worn in a non-game environment such as to support injured or tired muscles.

It is therefore a general object of this invention to provide protective gear in the form of a garment for normal everyday wear or during game play.

Another object of this invention is to provide a garment, as aforesaid, which has a user-selectable protective or support mode.

Still another object of this invention is to provide a garment, as aforesaid, which has a primary air channel extending along the garment seams for receiving pressurized air therein.

A further object of this invention is to provide a garment, as aforesaid, which has an array of secondary air tubes communicating with the primary air channel for receiving air therefrom.

Another object of this invention is to provide a garment, as aforesaid, wherein the secondary air tube array comprises a plurality of horizontal and vertical interwoven tubes.

Still another object of this invention is to provide a garment, as aforesaid, whereupon the secondary tube array expands upon inflation to decrease the spacing between the secondary tubes so as to protect the underlying body areas from outside forces.

Another particular object of this invention is to provide a garment, as aforesaid, which presents a valved air channel for allowing user-selectable inflation or deflation of the primary channel and secondary tube array connected thereto.

Other objects and advantages of this invention will become apparent from the following description taken in connection with the accompanying drawings, wherein is set forth by way of illustration and example, an embodiment of this invention.

DESCRIPTION OF THE PREFERRED EMBODIMENT

Figure 1:
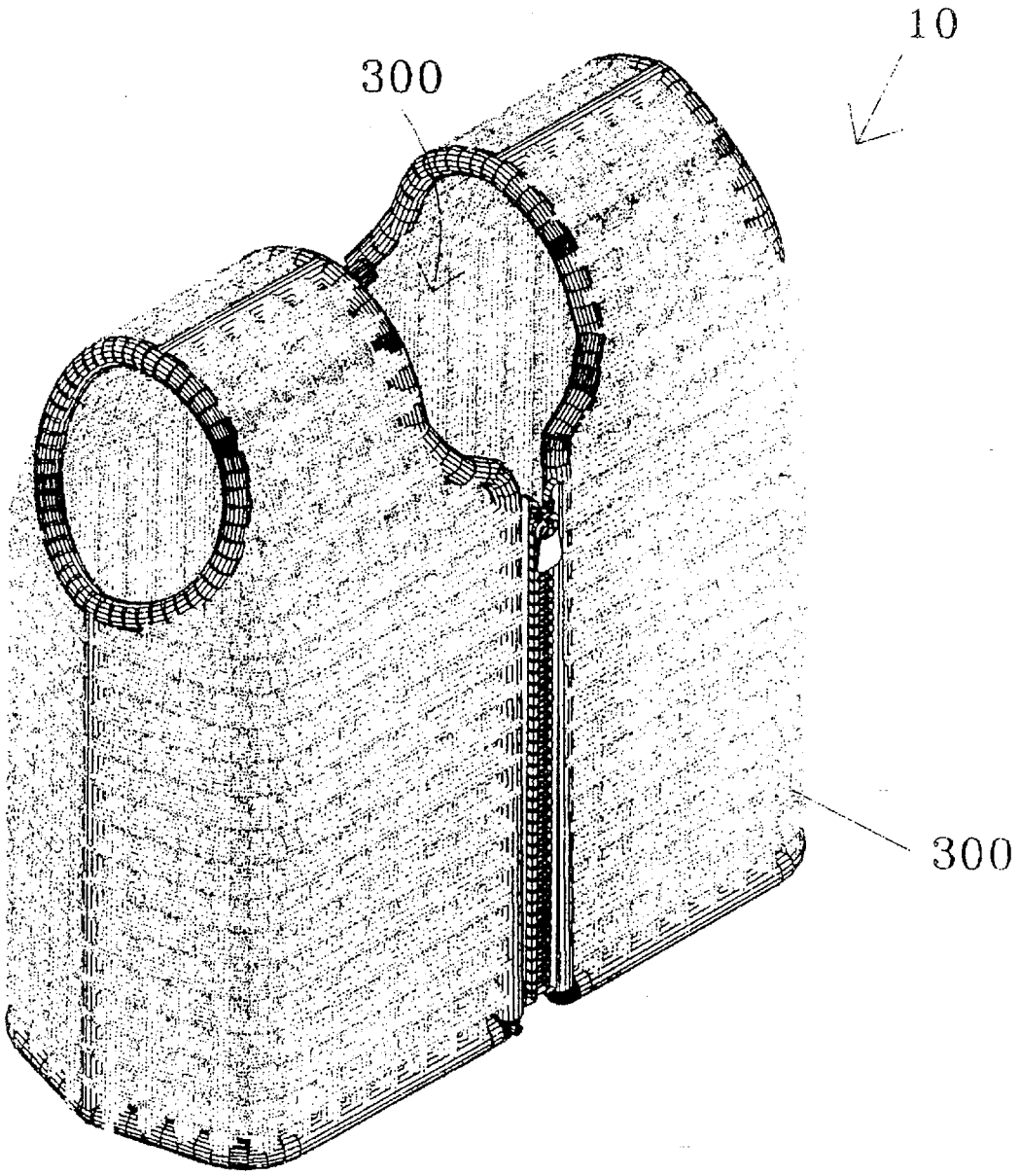
FIG. 1 is a perspective view of a protective garment for the torso area.
Figure 2:
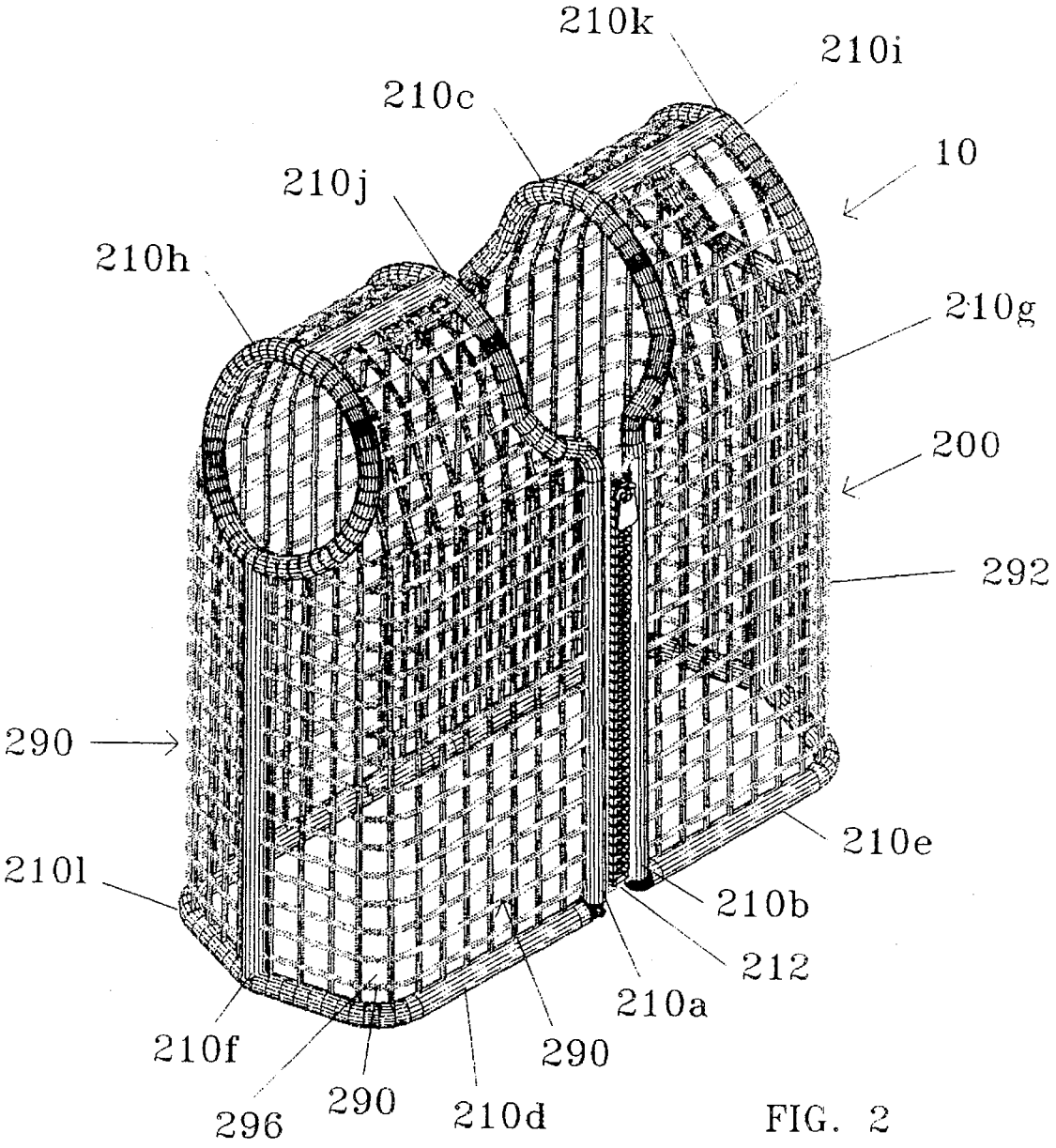
FIG. 2 is a perspective view of the garment of FIG. 1 with the inner and outer material layers removed to show the intermediate air channel and tube array.

Turning more particularly to the drawings, FIG. 1 shows one form of my invention in the form of a vest-like garment 10 for covering the torso of a wearer. It is understood that the garment may take other forms according to the body part to be protected and/or supported.

As such, the garment 10 comprises a plurality of layers 100, 200, 300 with the inner and outer layers 100, 300 being preferably made of a flexible, breathable material such as mesh or the like.

Positioned between the layers 100, 300 is an intermediate support layer 200. Support layer 200 includes a primary air channel 210 which extends along the normal seams of the garment, the seams defining the locations at which sections of the layers 100, 300 are joined together or terminate.

As such the primary channel 210 comprises first and second vertically extending sections 200*a*, 200*b* with a circular neck section 210*c* connected thereto. Front sections 210*d*, 210*e* extend from the vertical sections 210*a*, 210*b* and towards the side sections 210*f*, 210*g* which communicate with the arm holes 210*h*, 210*i*. These arm holes 210*h*, 210*i* further communicate with the neck section 210*c* by means of air channel sections 210*j*, 210*k*. A lower back section 2101 extends between the two side sections 210*f*, 210*g*.

These primary channel sections are preferably made of a flexible material such as expandable polymer with the primary air channels being in a generally flat condition when no air is found therein. All sections are in a fluid communication with either one or more adjacent sections.

At the lower end of the channel section 210*a* is a two-way air valve 250 which allows for entry of pressurized air into the section 210*a* of the primary air channel 210. The valve 250 is preferably a release-type valve so as to allow for quick air discharge upon manipulation by the user.

A zipper 212 is shown for joining sections 210*a*, 210*b* together. Although the zipper 212 is shown as attached to sections 210*a*, 210*b*, it is understood that the zipper 212 may be directly attached to the inner 100 and/or outer 300 layers. It is understood that other types of fasteners may be used to secure the vest 10 about the user's torso such as VELCRO® fasteners, laces or the like.

Extending between the sections of the primary air channel 210 and in communication therewith are grids 290. Each grid comprises a plurality of smaller air tubes also made of a polymeric material, the ends of the tubes being in communication with selected sections of the primary air channel 210. Each grid comprises a plurality of interwoven horizontal 292 and vertical 294 tubes with spaces 296 therebetween. This structure presents a latticed effect for each tube array 290 extending between sections of the primary air channel 210.

In use, the vest 10 in a normal condition presents a garment covering the torso of the wearer, the garment 10 being available for wear during normal game play. As such the primary air channel sections 210*a*–210*l* and secondary tube arrays 290 are relatively flat allowing for unrestricted user movement. Upon facing an impact situation, such as batting, the pressurized air is delivered to the primary channel 210 via the valve 250. Upon entry of the pressurized air into the channel section 210*a*, the air first fills the larger primary air channel 210 sections and then the smaller tubes 292, 294 of the tube arrays 290 so as to inflate the same.

Figure 3:
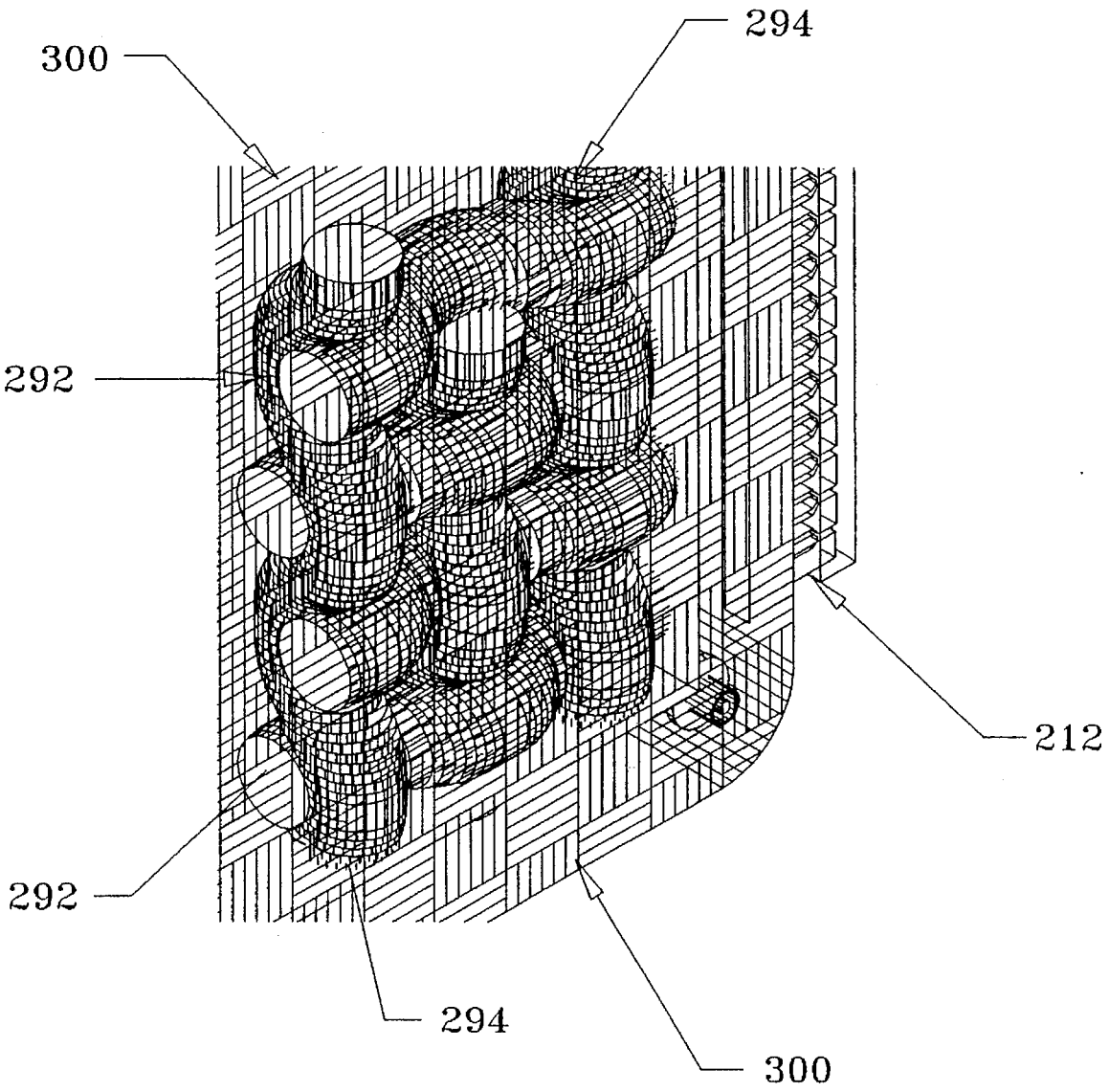
FIG. 3 is a fragmentary view of a portion of the garment showing the relationship between the horizontal and vertical tubes of the tube array upon tube inflation underneath the outer layer of material.
Figure 4:
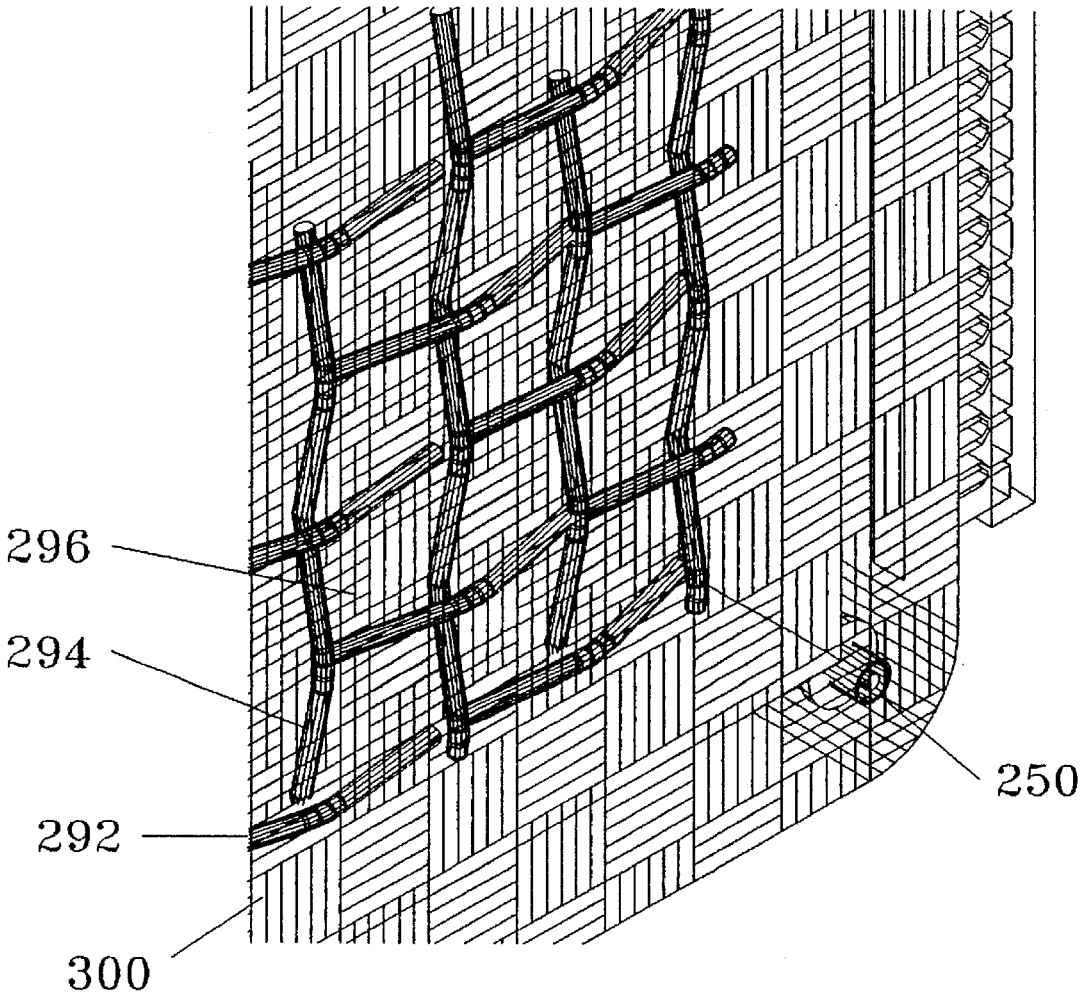
FIG. 4 is a fragmentary, perspective view showing the tube array of FIG. 3 in a deflated mode.

Upon inflation of the secondary tube array 290, the array 290 goes from a deflated FIG. 4 position to an inflated FIG. 3 position. This inflated mode diminishes or eliminates the spaces 296 between tubes 292, 294 and thus overlies the underlying body areas. Upon ball impact the force is dissipated away from the point of impact and towards the primary air channel 210 sections.

Subsequent to use, the valve 250 can be moved to a discharge position for allowing discharge of the pressurized air from the garment 10 and return of the garment 10 to its FIG. 4 position for normal use.

It is understood that the above structure can be utilized in various garments with the primary air channel 210 found at the normal seam location for the chosen garment with at least one secondary tube array extending therebetween. For example, in trousers the primary air channel sections will lie along the lateral sides of the leg and possibly present cuffs about the top and lower ends thereof with the secondary arrays extending between these primary channel sections. An arm protector may have a primary air channel running along one side of the arm with the ends of the tubes of the tube array being in communication with this single primary air channel. Other forms of garments may also be manufactured utilizing my novel design.

It is again understood that such garments utilizing my new design may be used in non-sports environments, e.g. to offer a compressive support for injured or tired muscles of a user.

It is to be understood that while certain forms of this invention have been illustrated and described, it is not limited thereto except insofar as such limitations are included in the following claims and allowable functional equivalents thereof.

Having thus described the invention, what is claimed as new and desired to be secured by Letters Patent is as follows:

1. A protective garment comprising:

a plurality of sections of flexible material joined together at seams for forming an inner layer of the garment, said joined sections presenting a configuration for covering a selected body part of a user;

a corresponding plurality of sections of flexible material joined together at seams for forming an outer layer of the garment, said joined sections presenting a configuration corresponding to said inner material layer;

an intermediate support layer made of a flexible material comprising:

a primary air channel extending along said seams, said primary air channel having an air inlet;

at least one air tube array presenting a plurality of interwoven air tubes with each of said air tubes having an end in fluid communication with said air channel;

valve means for regulating an entry or release of pressurized air into or from said air inlet, said air inflating said air channel and said at least one air tube array connected thereto, said inflation of said air tube array presenting said at least one tube array in an inflated mode for absorbing impact forces occurring thereon during said user wear.

2. The garment as claimed in claim 1 wherein said tube array comprises:

a first plurality of rows of said air tubes with each of said tubes having first and second ends communicating with a portion of said air channel; and a second plurality of rows of said air tubes traversing said first plurality of rows in a woven relationship therebetween, said tubes presenting spaces therebetween during the absence of air from said air channel.

3. The garment as claimed in claim 2 wherein said inflated mode reduces said spaces between said adjacent tubes.

4. The garment as claimed in claim 1 wherein said seams are connected to said air channel.

5. The garment as claimed in claim 1 wherein said garment is a vest for torso wear.

6. A protective garment comprising:

at least one layer of flexible material presenting at least one seam, said flexible material presenting a configuration for covering a selected body part of a user;

a support layer connected to said at least one layer and made of a flexible material comprising:

a primary air channel extending along said at least one seam, said primary air channel having an air inlet;

at least one air tube array presenting a plurality of interwoven air tubes with each of said air tubes having an end in fluid communication with said air channel;

valve means for regulating an entry or release of pressurized air into or from said air inlet, said air inflating said air channel and said at least one air tube array connected thereto, said inflation of said air tube array presenting said at least one tube array in a first mode for absorbing impact forces occurring thereon during said user wear.

7. The garment as claimed in claim 6 wherein said tube array comprises:

a first plurality of rows of said air tubes with each of said tubes having first and second ends communicating with a portion of said air channel; and a second plurality of rows of said air tubes traversing said first plurality of rows in a woven relationship therebetween, said tubes presenting spaces therebetween during the absence of air from said air channel.

8. The garment as claimed in claim 7 wherein said inflated mode reduces said spaces between said adjacent tubes.

9. A garment including at least one section of material presenting at least one seam, said garment covering a selected body part of a user, the garment comprising:

a primary air channel made of a flexible material extending along said at least one seam, said primary air channel having an air inlet;

at least one air tube array presenting a plurality of interwoven air tubes with each of said air tubes having an end in fluid communication with said air channel;

valve means for regulating an entry of pressurized air into said air inlet, said air inflating said air channel and said at least one air tube array connected thereto, said inflation of said air tube array presenting said at least one tube array in a first mode for absorbing impact forces occurring thereon during said user wear.

* * * * *